US005510015A

United States Patent [19]

Martinez et al.

[11] Patent Number: 5,510,015

[45] Date of Patent: Apr. 23, 1996

[54] PROCESS FOR OBTAINING A RANGE OF COLOURS OF THE VISIBLE SPECTRUM USING ELECTROLYSIS ON ANODIZED ALUMINIUM

[75] Inventors: Dionisio R. Martinez, Navarra, Spain; Mores A. Basaly, Marietta, Ga.; Davide Perina, Milan, Italy

[73] Assignee: Novamax Technologies Holdings, Inc., Ontario, Canada

[21] Appl. No.: 175,948

[22] Filed: Dec. 30, 1993

[30] Foreign Application Priority Data

Dec. 31, 1992 [ES] Spain ..... 9202672

[51] Int. Cl.$^6$ ..... C25D 11/20; C25D 11/22

[52] U.S. Cl. ..... 205/173; 205/105; 205/121; 205/324

[58] Field of Search ..... 205/105, 121, 205/173, 324

[56] References Cited

U.S. PATENT DOCUMENTS

| | | | |
|---|---|---|---|
| 3,850,762 | 11/1974 | Smith | 205/324 |
| 4,414,077 | 11/1983 | Yoshida et al. | 205/105 |
| 4,421,610 | 12/1983 | Rodriguez | 204/35 N |
| 4,808,280 | 2/1989 | Hinoda | 205/173 |
| 4,869,789 | 9/1989 | Kurze et al. | 205/324 |
| 4,968,389 | 11/1990 | Satoh et al. | 205/173 |

*Primary Examiner*—John Niebling
*Assistant Examiner*—Edna Wong
*Attorney, Agent, or Firm*—Helfgott & Karas

[57] ABSTRACT

A process for obtaining a range of colors of the visible spectrum includes a first phase to form an anodic film, a second phase to modify a barrier film and a third phase to deposit metallic particles on the barrier film. During the formation of the anodic film, a thickness in excess of 0.3 μm is obtained. The electrolytic modification of the barrier film is carried out in a low dissolving power electrolyte, applying a predetermined low voltage and a predetermined low current density. The third phase is carried out by an electrolytic deposition of metallic particles in order to increase internal reflections under the deposit. The average voltage applied in the electrolytic modification of the barrier film is below 5 volts of a complex alternating current, and the average density of the current applied is less than 200 mA/dm$^2$ of the complex alternating current.

10 Claims, 7 Drawing Sheets

PROCESS FOR OBTAINING A RANGE OF COLOURS OF THE VISIBLE SPECTRUM USING ELECTROLYSIS ON ANODIZED ALUMINIUM

OBJECT OF THE INVENTION

The present invention relates to a new process that has been particularly designed for obtaining a range of colours of the visible spectrum using electrolysis on anodized aluminium parts.

BACKGROUND OF THE INVENTION

The coloration of anodized aluminium for decorative and aesthetic purposes in architectural applications has been a permanent need for over 40 years.

Initially the system used was COLORATION BY IMPREGNATION of the porous anodic film with organic or mineral pigments. The greatest disadvantage of these systems was the lack of stability of the colours to atmospheric exposure.

Another very old coloration system is INTEGRAL COLORATION. Such is essentially based upon the use of aluminium alloys containing certain intermetallic elements or compounds, insoluble in the electrolyte used in the anodizing process. During formation of the anodic film the intermetallic compounds are trapped inside the same, originating a limited range of gold, bronze, grey and black colours.

The films produced using this system are extremely hard, with an excellent resistance to corrosion. The colours obtained are also very strong to sunlight.

This aluminium coloration system however poses a number of problems, in particular as follows:

- In order for the colour to be uniform, a very precise control is required in preparing and homogenizing the alloy, and later transforming the same, i.e. at the extrusion or lamination stages.
- A very precise control of the anodizing electrolyte is also required.
- Voltages much greater than those used in conventional anodizing are required. Consequently, energy consumption is far greater, and may be calculated to be 5 to 10 times greater than in conventional anodizing, obviously rendering this system almost inadmissible.
- Colour intensity is intimately linked to the thickness of the film obtained.

The above problems per se indicate the scarce practical interest of this alumnium coloration system.

The system of METALLIC ELECTROLYTIC COLORATION of anodized aluminium appeared towards the end of the nineteen sixties. In these processes, coloration is obtained by deposition and accumulation of metallic particles from the bottom of the pores towards the surface portion of the anodic film.

The colour is produced by different optical effects, namely refraction, deflection, absorption and internal reflection of light, falling on and crossing the transparent anodic film.

The incidence of light on the surface of the metallic deposit barely causes preferential absorption of the electromagnetic waves of the visible spectrum. Almost all metals produce a slightly yellowish colour, saving transition metals such as copper which further yield orange and reddish colours.

On increasing the side surface of the metallic deposit, the internal reflections are multiplied, thereby to increase diffuse reflection and hence internal absorption of all the electromagnetic waves of the visible spectrum. This leads to a shaded darkening of the yellowish colour, yielding a brown colour which has actually been designated bronze, and can even be a black.

This coloration system currently produces a limited range of gold, bronze and black colours. Although copper deposition can yield a range of reddish colours, this technique is rarely used because of the potential risks of corrosion it entails. The quality and stability of these finishes is optimal.

In the mid-nineteen seventies, a new technique of electrolytic coloration came to light, whereby it was possible to obtain new colours. This technique was actually designated ELECTROLYTIC COLORATION BY OPTICAL INTERFERENCE. U.S. Pat. Nos. 4,066,816, 4,251,330 and 4,310,586 describe different techniques of this coloration system.

The theoretical explanation of the process given in such patents is the following:

When a beam of white light falls on an anodic film a part of it is reflected and the other part crosses it, and its path is deviated due to a refraction effect.

A part of the beam crossing the anodic film is again reflected on falling on the metallic deposit, located at the bottom of the pores. The other part of the beam crosses the anodic film to arrive at the surface of the metal where it is reflected.

When separation between the plane defined by the upper surface of the metallic deposit and that of the aluminium surface acquires certain values, optical interference effects, constructive or destructive, can come about, and give rise to some of the colours of the visible spectrum.

The optical interference effect produced when a beam of light falls on and crosses a thin transparent film in a medium with a different refractive index is a known fact, described in any elementary optics text. (Francis Weston Sears. Principles of Physics Series. OPTICS. CHAPTER 8: INTERFERENCE. 8.1. INTERFERENCE IN THIN FILMS, page 203).

U.S. Pat. Nos. 4,066,816, 4,251,330 and 4,310,586 on electrolytic coloration by interference basically claim an effect and the conditions in which the same takes place which have been known for many years.

Without questioning the legal validity of the said patents, they are at fault from a theoretical standpoint, as follows:

They consider the layer delimited by the metal surface and an imaginary parallel surface comprising the upper part of the metallic deposit a thin layer. This layer is obviously discontinuous, being entirely different to the area taken up by the pores, where metallic particles are deposited, and not the porous portion constituted by aluminium oxide. It is difficult to imagine that the area between pores shall have a different refractive index to the rest of the anodic film and furthermore, if such were to be the case, that the said area would be perfectly distinct in a parallel plane from the metal surface (essential conditions for the interference effect to be produced).

Obviously, no optical interference can come about in the area of the layer taken up by the metallic deposit, for the white light cannot cross the metal and can only be more or less anarchically reflected, to cause a diffuse reflection.

The technique developed according to the theoretic model described in the above patents allows some colours of the visible spectrum to be obtained, preferably a bluish grey. From the practical standpoint the process poses huge repetitiveness and uniformness difficulties and has not therefore been widely applied industrially.

DESCRIPTION OF THE INVENTION

Taking the three conventional phases in the process for obtaining a range of colours of the visible spectrum using electrolysis on anodized aluminium, viz. a first phase to form an anodic film, a second phase to modify the barrier film and a third phase to deposit metallic particles on the barrier film, the characteristics of the invention lie in the following:

A thickness in excess of 0.3 μm is established at the first phase, namely formation of the anodic film.

The second phase, namely the electrolytic modification of the barrier film, is carried out in a low dissolving power electrolyte, applying a low voltage and a low current density.

Finally, the third operative phase, namely to deposit metallic particles on the barrier film, is carried out by a slight electrolytic deposition of metallic particles in order to increase internal reflections under the said deposit.

In accordance with another characteristic of the invention, the electrolyte used in modifying the barrier film has a dissolving power in aluminium oxide equivalent to a solution of sulphuric acid at a concentration of less than 12 g/l and at room temperature, preferably between 20° and 25° C.

In accordance with another characteristic of the invention, the average voltage applied in the electrolytic modification of the barrier film is below 5 volts of a complex alternating current.

In accordance with another characteristic of the invention, the average current density applied in the electrolytic modification of the barrier film is less than 200 mA/dm$^2$ of a complex alternating current.

In accordance with another characteristic of the invention, the obtention of the various colours is effected by electrolytically modifying the crystalline lattice of the barrier film and then slightly electrolytically depositing metallic particles. The said electrolytic modification of the crystalline lattice of the barrier film essentially depends on the peak voltages of the positive and negative semi-cycles of the a.c.-complex current applied; on the average voltages of the positive and negative semi-cycles of the a.c.-complex current applied; on the average intensity of the a.c.-complex current applied; and on the time of duration of the electrolytic modification phase of the crystalline lattice of the barrier film.

In accordance with another characteristic of the invention, the peak voltages of the positive and negative semi-cycles of the a.c.-complex current applied are less than 7 volts, whereas the average voltages of the positive and negative semi-cycles of the a.c.-complex current applied are less than 2.5 volts, the average intensity of the a.c.-complex current applied is less than 200 mA/dm$^2$ and the distance between the upper part of the light deposit of the metallic particles and the aluminium-alumina interface is less than 50 nm.

In accordance with another characteristic of the invention, when a white-opaque colour is to be obtained, the process comprises two phases, namely a first phase to form the anodic film in which a thickness in excess of 0.3 μm is established; and a second phase to electrolytically modify the barrier film that is carried out in a low dissolving power electrolyte, applying a low voltage and a low current density.

More specifically, the average current density applied in electrolytically modifying the barrier film is less than 120 mA/dm$^2$ of a complex alternating current.

Finally and in accordance with another characteristic of the invention, in order to obtain a grey colour, an appropriately opaque white colour is previously obtained, and then a phase of electrolytic deposition of metallic particles follows.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figure 1:
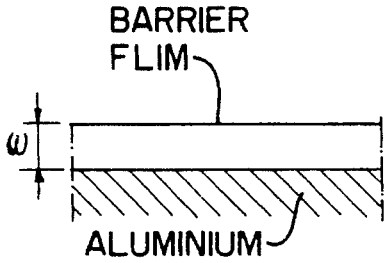
FIG. 1, sequences (1-1 to 1-9) thereof, shows the mechanism to form the anodic film during the anodizing process.
Figures 1, 2:
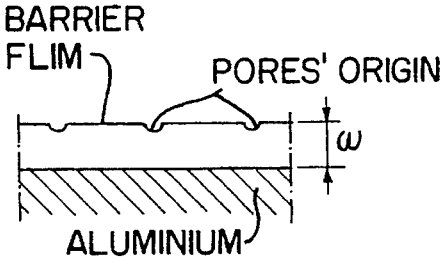
FIG. 2.-sequences (2-1 to 2-3) Shows the packaging of the crystalline lattice, in particular a coordination polyhedron with a hexagonal package.
Figures 1, 2, 3:
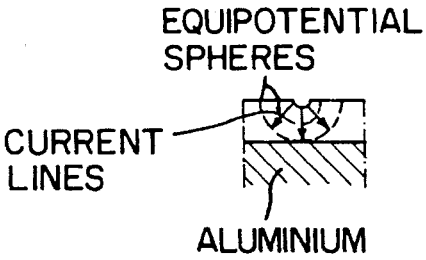
FIG. 3.-Shows a diagram of the electromagnetic spectrum, based upon frequencies and wavelengths, upon which the visible spectrum is duly marked.
Figures 1, 2, 3, 4:
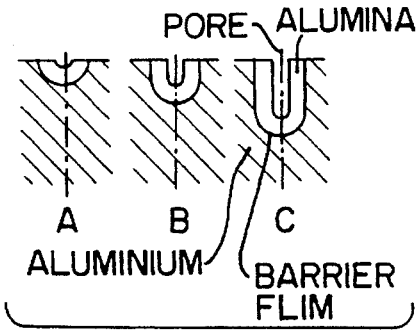
FIG. 4.-Shows a diagram of the said visible spectrum for blue, green and red colours.

The new system of electrolytic coloration of aluminium is based on the modification of the crystalline lattice of the barrier film, produced by anodizing on an aluminium or aluminium alloy object, prior to eventual electrolytic deposition of metallic or other particles. We shall call this new coloration system CRYSTALLINE ELECTROLYTIC COLORATION, to distinguish it from the conventional systems of metallic or optical interference coloration systems.

The theoretic model of the CRYSTALLINE ELECTROLYTIC COLORATION system is based on a number of verified experimental facts, most significant being the following:

Mechanism to form the anodic film during the anodizing process. (See FIGS. 1-1 to 1-9). (S. Wernick, R. Pinner and P. G. Sheasby. THE SURFACE TREATMENT AND FINISHING OF ALUMINIUM AND ITS ALLOYS. Chap. 6. Cell dimensions, The Manchester School; direct observation of pores and barrier layers).

By analysing the same it can be inferred that the dimensions of the hexagonal cells, the thickness of the barrier film, the thickness of the walls and the diameter of the pores are directly related to the voltage applied during the process, as follows:

| | |
|---|---|
| barrier layer, d | 10.4 Angstroms/volt |
| cell diameter, c | 27.7 |
| cell wall | 0.71 × barrier layer |
| since pore diameter, | p = c − (2 × 0.71 d) |
| pore diameter, | p = 12.9 Angstroms/volt |

Gel nature of the alumina during the formation thereof which allows the molecules a certain mobility. This justifies the known RECOVERY EFFECT (S. Wernick, R. Pinner and P. G. Sheasby. THE SURFACE TREATMENT AND FINISHING OF ALUMINIUM AND ITS ALLOYS. Chapter 6. Recovery effect).

It should importantly be noted that the metal surface located right under each pore is not flat, but concave-spherical, which is essential in explaining the production of the different colours of the visible spectrum in CRYSTALLINE ELECTROLYTIC COLORATION.

The density of the anodic film is irregular and increases with depth. This explains that the hardness is greater at the barrier film area.

As the dissolving power of the electrolyte decreases, the density of the anodic film increases and the diameter of the pores is reduced. Conversely, as the dissolving power of the electrolyte decreases the density of the anodic film increases and the diameter of the pores is enlarged.

Basically, the CRYSTALLINE ELECTROLYTIC COLORATION process sequence is as follows:

A) Firstly, a barrier film is produced by electrolytic means on the aluminium or aluminium alloy part. For the Crystalline Electrolytic Coloration process it makes no difference whether the barrier film has a porous film on top or otherwise. For architectural applications we shall however start with an anodic film with a thickness lying between 15 μm and 25 μm, produced in conventional conditions:

| | |
|---|---|
| Electrolyte | sulphuric acid |
| Concentration | 200 g/l |
| Temperature | 20° C. |
| Current density | 1.5 A/dm$^2$ |
| Voltage applied | 16 volts (approx.) |
| Current type | DC |

B) Next, we shall proceed to modify the crystalline structure of the barrier film, as follows:

An electrolyte with a low dissolving power in aluminium oxide is prepared. For instance, sulphuric acid at a concentration of less than 12 g/l. The dissolving power is limited by keeping the temperature below 25° C.

In the above-defined electrolyte the previously anodized aluminium part undergoes a second electrolytic treatment. This treatment involves applying an AC-complex electric current to the aluminium part, with the positive semi-cycle being greater than the negative one. For instance, with the complete positive semi-cycle and the negative one cut down to half (see the figures in the practical embodiments).

The voltage equivalent to AC-pure current from which the AC-complex current proceeds must be under 5 volts. This means that the positive semi-cycle must have a peak voltage of below 7 volts. The current circulating must be under 200 mA/dm$^2$. In these conditions the crystalline structure of the barrier film begins to be modified by means of the RECOVERY EFFECT.

The characteristics of the AC-complex electric current, the peak voltages of the positive and negative semi-cycles and the duration of the process in the modification of the crystalline structure of the barrier film depend on the colour that is being aimed at: white-opaque, red, orange, yellow, green, blue or violet, primarily.

The modification of the crystalline structure of the barrier film is due to the following:

If an AC-Symmetrical or AC-Complex current is applied to an anodized aluminium part in a low dissolving power electrolyte during the positive semi-cycle the current circulating produces more alumina which is accumulated and compacted, precisely and only at the area through which the current circulates. This can cause the crystalline lattice to be packed, similarly to that of a coordination polyhedron with a hexagonal package. (See FIGS. 2-1 to 2-3, which show a coordination polyhedron with a hexagonal package). (José Luis Amorós, CRYSTALS, INTRODUCTION TO THE SOLID STATE), Chapter 10. Packed and coordination structures).

This packaging area performs as a set of crystals built into the crystalline lattice of the anodic film. The package area is located in the barrier film, under the bottom of the pores and close to the metal-oxide interface. The lower portion is concave-spherical in shape and optically performs as a spherical mirror. The size of the package area depends on the peak voltage applied during the modification phase of the crystalline lattice, by the recovery effect. We shall henceforth refer to these packages as BARRIER CRYSTALS, since they can be found in the barrier film between the bottom of the pores and the metal.

The BARRIER CRYSTALS have physical characteristics that differ from the rest of the barrier film and from the porous anodic film located on the upper portion. As the barrier crystals evolve with the passage of current the following essentially increases:

Electrical resistance.

Dielectric coefficient.

Refractive index.

Density.

Chemical resistance.

When the process to modify the crystalline structure of the barrier film is made at a very low current density (below 120 mA/dm$^2$) a surprising thing happens. After a few minutes the anodic film loses its transparency and acquires an opaque appearance, similar to the effect that comes about during chromic anodizing.

It has also been found that the resistance of opacified anodic films to corrosion is far greater than that of unopacified anodic films, produced in the same conditions. This might be due to the greater compactness of the alumina at the area beneath the bottom of the pores, where the crystalline lattice is bundled, which renders the same more impermeable.

The opacifying process described above is produced exactly the same irrespective of the thickness of the anodic film. Anodic films with a thickness of just a few tenths of a micron are perfectly opacified.

Bearing in mind that opacifying increases the resistance to corrosion of the anodic film, they could be used as an anchoring base for paints, to substitute the conventional chemical conversion by chromatation or the like.

The first conclusion obtained from the theoretic model of the CRYSTALLINE ELECTROLYTIC COLORATION system is that in opacifying the anodic film an effect similar to that which comes about when light falls on white and opaque paint comes about. (Francis Weston Sears. Principles of Physics Series. OPTICS. CHAPTER 14: COLOUR. 14-8 The colour of paints and inks, page 364). The white-opaque colour is simply due to the innumerable internal reflections and refractions of the light on striking the many barrier crystals and against the metal surface, contemporaneously causing an increased diffuse reflection to the detriment of specular reflection. It is for this same reason that snow is white, clouds are white, ground glass dust is white and so forth.

In light of the above it can be estimated that OPACIFYING THE BARRIER FILM IS BASICALLY WHAT PRODUCES THE WHITE ELECTROLYTIC COLOUR. What happens is that the inclusion of intermetallic elements in the anodic film shades the white colour and causes a more or less greyish effect. To the extent that the anodic film produced in the anodizing process is more transparent and colourless the white colour will be purer.

This conclusion is useful to justify the opaque appearance of the anodic film obtained in a chromic medium.

C) We finally electrolytically deposited a very slight layer of metallic particles on the bottom of the pores, on the upper part of the barrier crystals lattice. This layer acts as a mirror seen from inside the BARRIER CRYSTALS. In such conditions a number of reflection, refraction, deflection, absorption and interference effects are produced both inside and outside the barrier crystals, giving rise to the obtention of the different colours of the visible spectrum.

The conditions of the electrolytic deposition phase of metallic particles differ substantially from those of conventional electrolytic coloration.

To guarantee a light and uniform deposit the aforesaid electric parameters must be very precisely regulated and controlled. It is also necessary to eliminate the induction effects that could come about in transporting the electric energy between the current generator and the electrolytic vat.

The layout and number of barrier crystals and the values of their refractive indices are controlled by regulating the electrical parameters (peak voltages, average voltages, current quantity) of the positive and negative semi-cycles.

The electrolytic deposition phase of a very light layer of metallic particles can be conducted in the same electrolyte in which the modification of the crystalline structure of the barrier film was made, by only adding the respective metallic salts to the said electrolyte.

The compatibility between the two phases of a same electrolyte is possible because the electrical conditions of the modification phase of the crystalline lattice do not allow the deposition of metallic particles.

In fact, bearing in mind that the visible spectrum is no more than a part of a ELECTROMAGNETIC SPECTRUM, crystalline electrolytic coloration is no more than the attraction of a wavelength, corresponding to a given colour. Just as we tune into a radio station or television channel (see FIG. 3, Electromagnetic spectrum and FIG. 4, Visible spectrum). The technique in the CRYSTALLINE ELECTROLYTIC COLORATION system can be applied to attract and absorb other frequencies of the electromagnetic Spectrum. We would thus find an application to increase the performance of solar energy collectors.

CRYSTALLINE ELECTROLYTIC COLORATION is a new means for surface treatment of aluminium (anodized or otherwise) and other metals.

The most immediate applications of this new technology are:

WHITE Colour (opacified)

GREY Colour

BRONZE Colours (similar to permanganate acetate bronze)

BLUE Colours

GREEN Colours

YELLOW Colours

ORANGE Colours

RED Colours

VIOLET Colours

Other transition colours of the visible spectrum

Filter films to collect solar energy

Thin opaque films as a paint base

Thin opaque films on other metals as a paint base

EXAMPLES

Example 1: Blue Crystalline Electrolytic Coloration.

Anodizing phase: The part to be treated is previously anodized under the following conditions:

| | |
|---|---|
| Electrolyte | sulphuric acid |
| Concentration | 180 g/l |
| Temperature | 20° C. |
| Current density | 1.5 A/dm$^2$ |
| Voltage applied | 16.5 volts (approx.) |
| Current type | DC |
| Duration | 35 minutes |

Phase to modify the barrier film: The anodized part is then treated to modify the crystalline structure of the barrier film, under the following conditions:

| | |
|---|---|
| a) Composition of the electrolyte: | |
| $SnSO_4$ | 4 g/l |
| o-phenolsulphonic acid | 1 g/l |
| $H_2SO_4$ | 10 g/l |
| b) Temperature | 22° C. |
| c) Duration | 15 minutes |
| d) Current type | AC-Complex |

Figures 1, 2, 3, 4, 5, 6, 7, 8, 9:
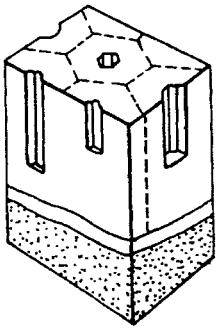
FIGS. 5, 6, 7 and 8.-Show the wave shapes at the different process phases when the process is designed for blue crystalline electrolytic coloration.
FIGS. 9 and 10.-In turn show the wave shape of white-opaque crystalline electrolytic coloration.
Figures 1, 2, 3, 4, 5:
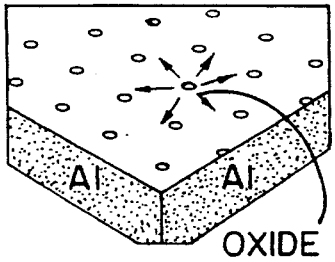
Figures 1, 2, 3, 4, 5, 6:
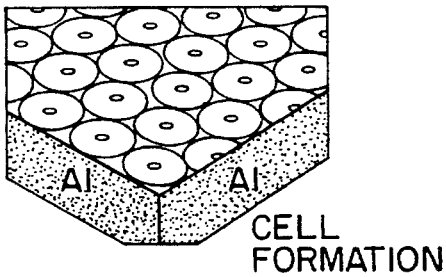
Figures 1, 2, 3, 4, 5, 6, 7:
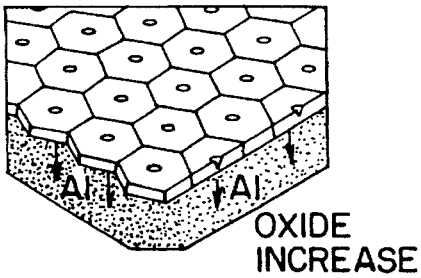
Figures 1, 2, 3, 4, 5, 6, 7, 8:
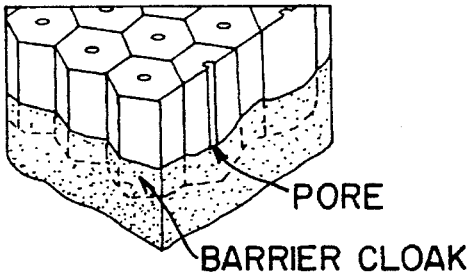
Figures 1, 2:
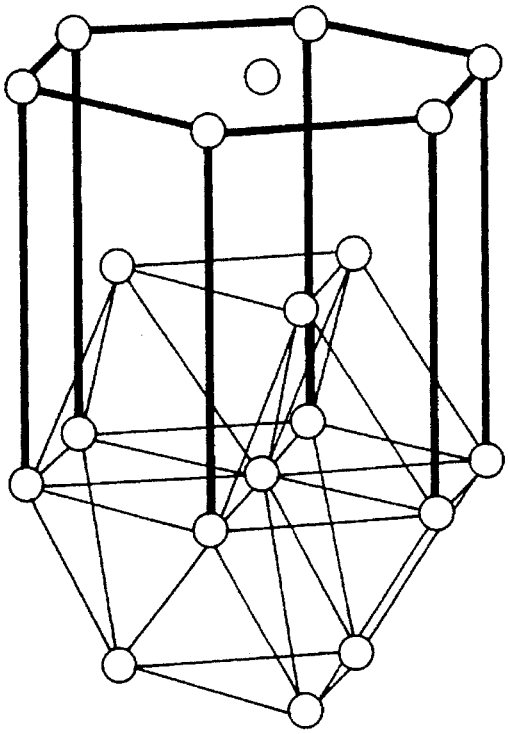
Figure 2:
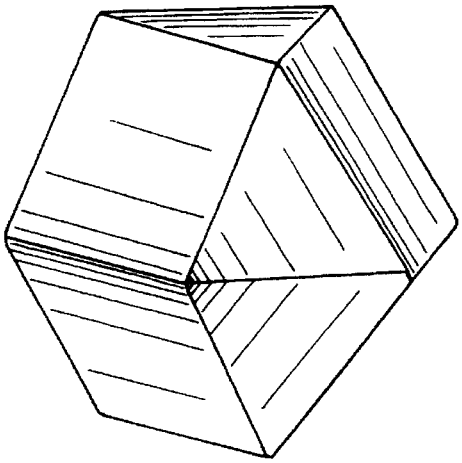
Figures 2, 3:
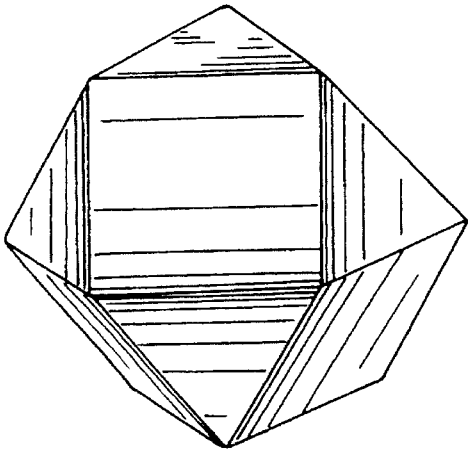
Figure 3:
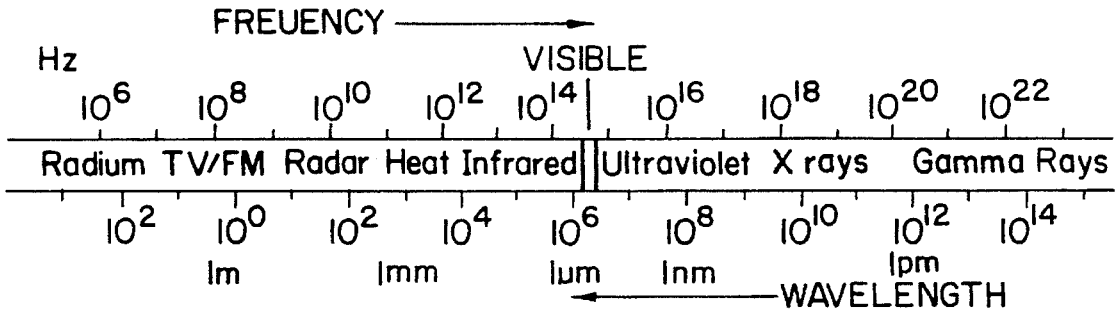
Figure 4:
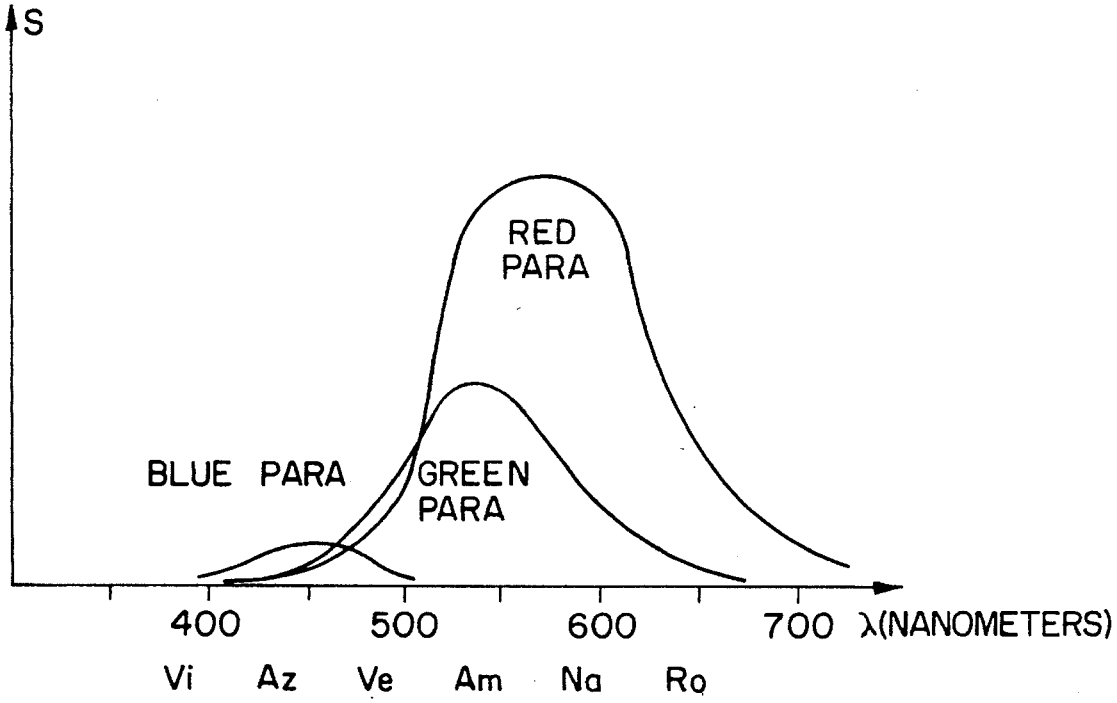
Figure 5:
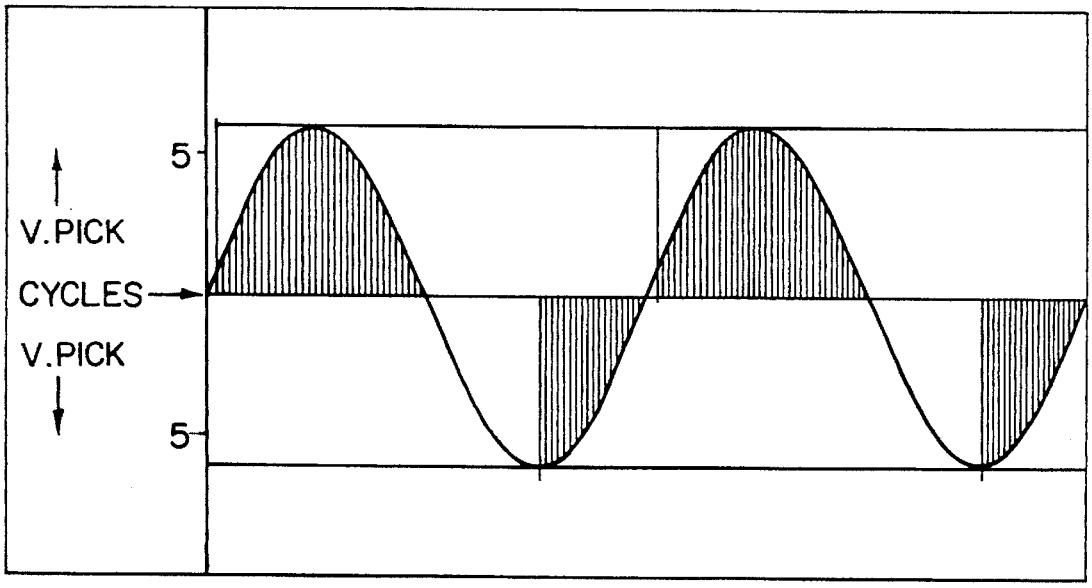
Figure 6:
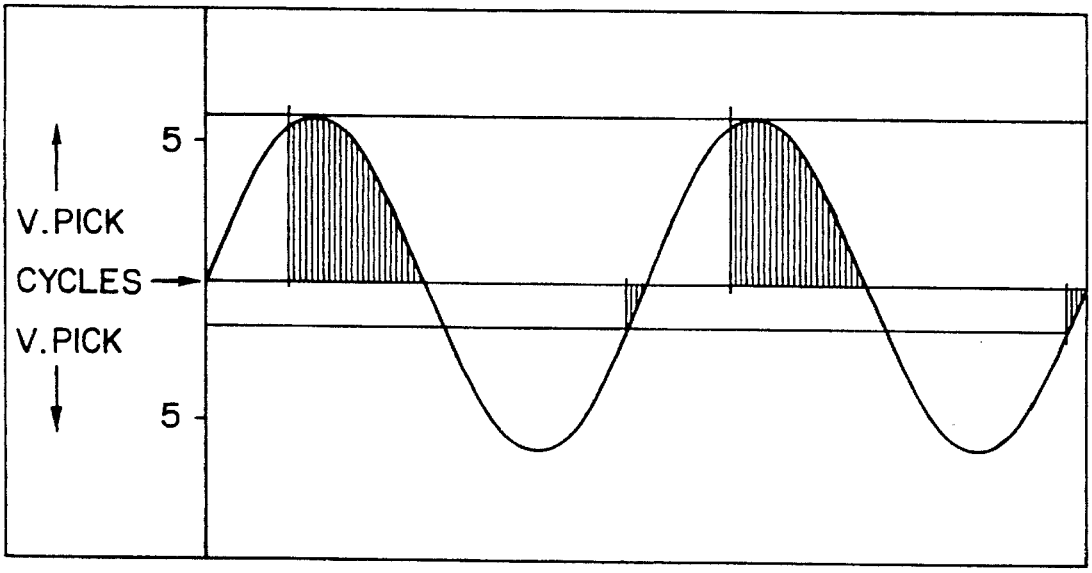
Figure 7:
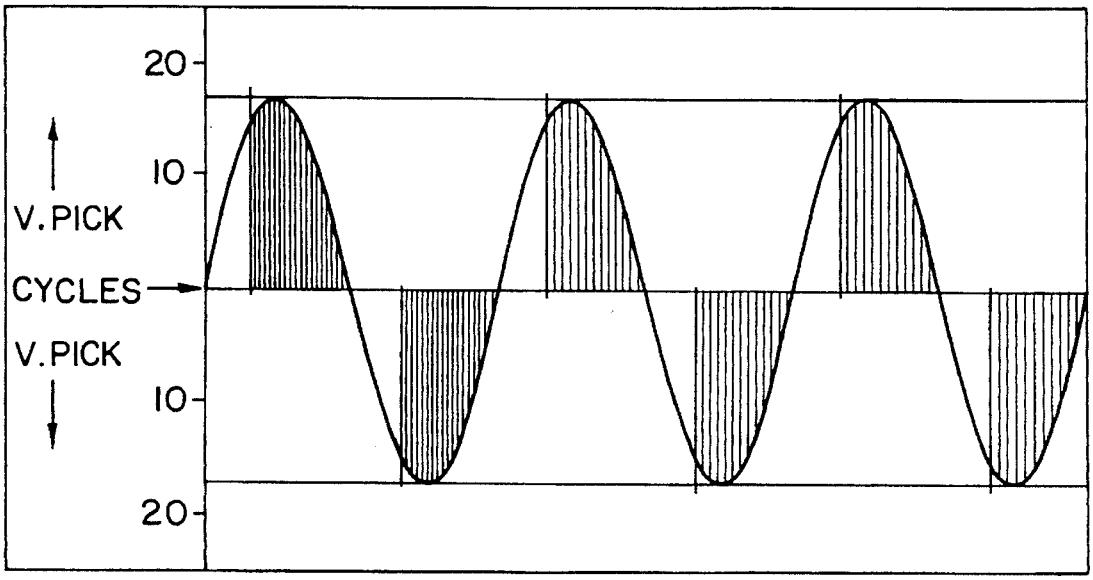
Figure 8:
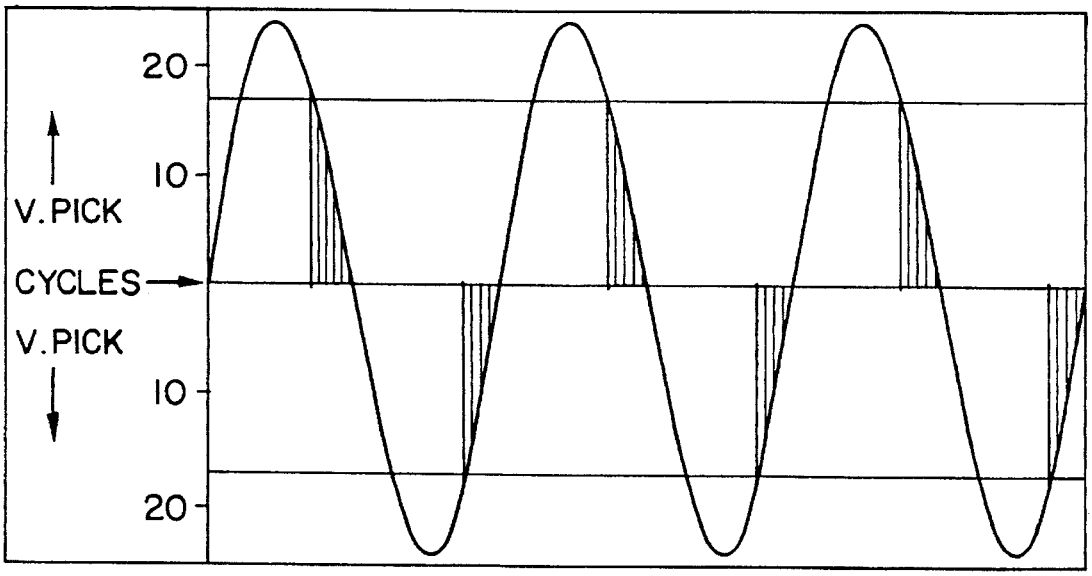
Figure 9:
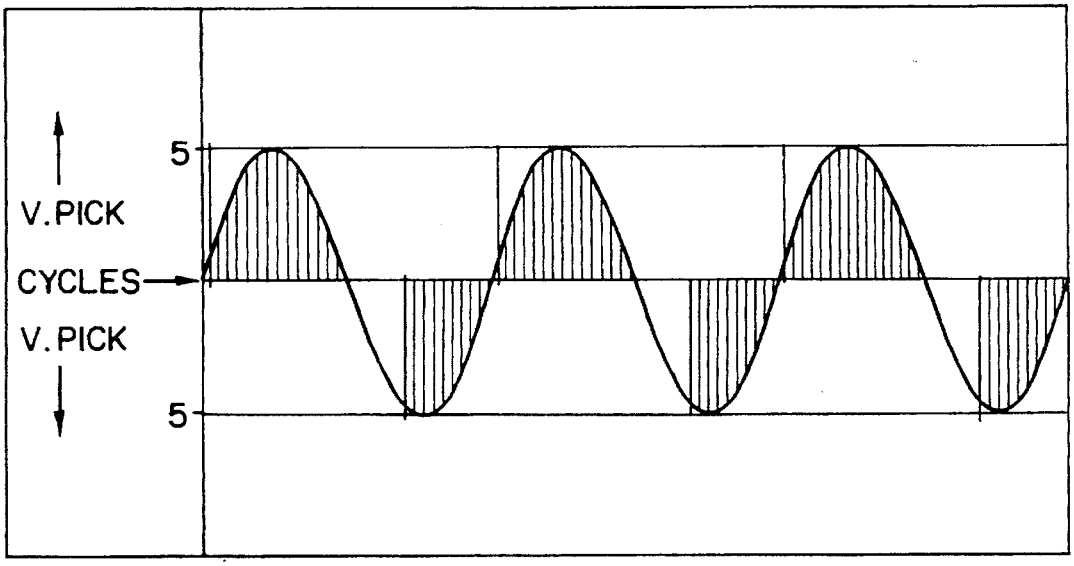

The characteristics and wave shape are detailed in tables 1 and 2 and in FIGS. 5 and 6. During the process the conduction angles of the positive and negative semi-cycles are separately modified in order to control current circulation (at a value below 150 mA/dm$^2$) between the initial and final process conditions.

Coloration phase as such: The part then undergoes an electrolytic deposition treatment of metallic particles, under the following conditions:

| | |
|---|---|
| a) Composition of the electrolyte: The same as in the above phase to modify the barrier film. | |
| b) Temperature of the electrolyte: The same as in the above phase to modify the barrier film. | |
| c) Duration | 2 minutes |
| d) Current type | AC- Complex |

The characteristics and wave shape are detailed in tables 3 and 4 and in FIGS. 7 and 8. During the process the conduction angles of the positive and negative semi-cycles are separately modified in order to control current circulation (at a value below 0.40 A/dm$^2$) between the initial and final process conditions.

When this phase is over a beautiful turquoise blue colour is obtained, very similar in appearance to that obtained in coloration by immersion with organic colouring.

TABLE 1

| CRYSTALLINE ELECTROLYTIC COLORATION | Vrms | α/β SCR | Vaverage | Vpeak |
|---|---|---|---|---|
| TRANSFORMER (Maximum voltage) | 10.00 | | 9.00 | 14.14 |
| POSITIVE SEMI-CYCLE: | | | | |
| SCR conduction angle, (minimum) | | 25.11° | | 6.00 |
| SCR conduction angle | | 170.00° | 1.895 | 6.00 |
| NEGATIVE SEMI-CYCLE: | | | | |
| SCR conduction angle | | 85.00° | 0.868 | 5.98 |
| A.C.-complex | | | 2.764 | |
| A.C. full wave | | | 3.820 | 6.00 |

TABLE 2

| CRYSTALLINE ELECTROLYTIC COLORATION | Vrms | α/β SCR | Vaverage | Vpeak |
|---|---|---|---|---|
| TRANSFORMER (Maximum voltage) | 10.00 | | 9.00 | 14.14 |
| POSITIVE SEMI-CYCLE: | | | | |
| SCR conduction angle, (minimum) | | 25.11° | | 6.00 |
| SCR conduction angle | | 110.00° | 1.282 | 6.00 |
| NEGATIVE SEMI-CYCLE: | | | | |
| SCR conduction angle | | 15.00° | 0.008 | 1.55 |
| A.C.-complex | | | 1.290 | |
| A.C. full wave | | | 3.820 | 6.00 |

TABLE 3

| CRYSTALLINE ELECTROLYTIC COLORATION | Vrms | α/β SCR | Vaverage | Vpeak |
|---|---|---|---|---|
| TRANSFORMER (Maximum voltage) | 20.00 | | 18.00 | 28.27 |
| POSITIVE SEMI-CYCLE: | | | | |
| SCR conduction angle, (minimum) | | 36.96° | | 17.00 |
| SCR conduction angle | | 120.00° | 4.058 | 17.00 |
| NEGATIVE SEMI-CYCLE: | | | | |
| SCR conduction angle | | 120.00° | 4.058 | 17.00 |
| A.C.-complex | | | 8.117 | |
| A.C. full wave | | | 10.823 | 17.00 |

TABLE 4

| CRYSTALLINE ELECTROLYTIC COLORATION | Vrms | α/β SCR | Vaverage | Vpeak |
|---|---|---|---|---|
| TRANSFORMER (Maximum voltage) | 20.00 | | 18.00 | 28.27 |
| POSITIVE SEMI-CYCLE: | | | | |
| SCR conduction angle, (minimum) | | 36.96° | | 17.00 |
| SCR conduction angle | | 45.00° | 0.792 | 17.00 |
| NEGATIVE SEMI-CYCLE: | | | | |
| SCR conduction angle | | 45.00° | 0.792 | 17.00 |
| A.C.-complex | | | 1.585 | |
| A.C. full wave | | | 15.305 | 17.00 |

Example 2: White-opaque Crystalline Electrolytic Coloration.

Anodizing phase: The part to be treated is previously anodized under conditions similar to example 1.

Phase to modify the barrier film: The anodized part is then treated to modify the crystalline structure of the barrier film, under the following conditions:

| | |
|---|---|
| a) Composition of the electrolyte: | |
| $NiSO_4$ | 10 g/l |
| $SnSO_4$ | 4 g/l |
| tartaric acid | 2 g/l |
| $H_2SO_4$ | 8 g/l |
| b) Temperature | 20° C. |
| c) Duration | 20 minutes |
| d) Current type | AC-Complex |

Figure 10:
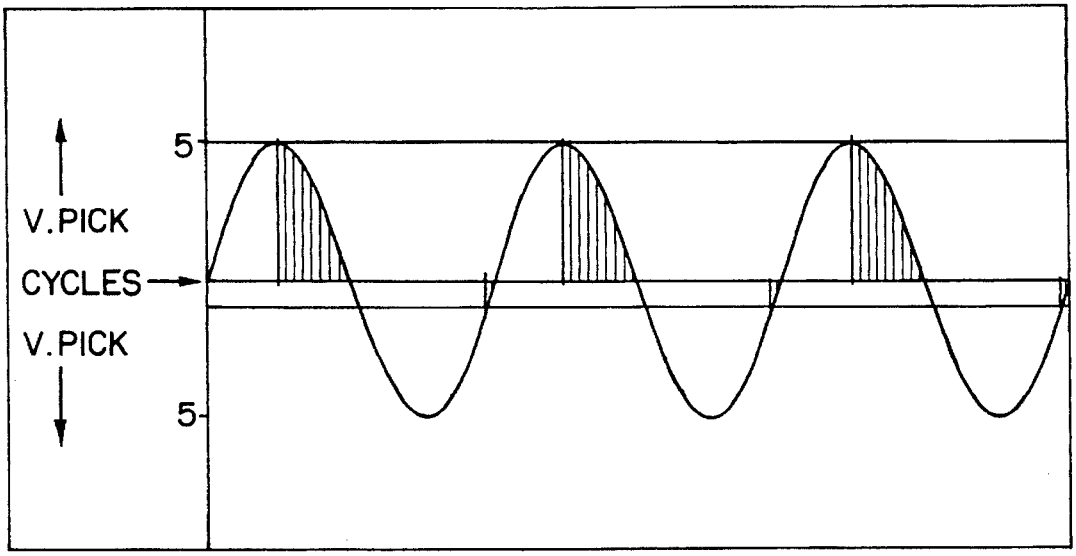

The characteristics and wave shape are detailed in tables 5 and 6 and in FIGS. 9 and 10. During the process the conduction angles of the positive and negative semi-cycles are separately modified in order to control current circulation (at a value below 100 mA/dm$^2$) between the initial and final process conditions.

When this phase is over a beautiful white-opaque colour is obtained, which is slightly greyish depending upon the components of the alloy.

TABLE 5

| CRYSTALLINE ELECTROLYTIC COLORATION | Vrms | α/β SCR | Vaverage | Vpeak |
|---|---|---|---|---|
| TRANSFORMER (Maximum voltage) | 20.00 | | 18.00 | 28.27 |
| POSITIVE SEMI-CYCLE: | | | | |
| SCR conduction angle, (minimum) | | 19.19° | | 5.00 |
| SCR conduction angle | | 170.00° | 1.579 | 5.00 |
| NEGATIVE SEMI-CYCLE: | | | | |

TABLE 5-continued

| CRYSTALLINE ELECTROLYTIC COLORATION | Vrms | α/β SCR | Vaverage | Vpeak |
|---|---|---|---|---|
| SCR conduction angle | | 110.00° | 1.068 | 5.00 |
| A.C.-complex | | | 2.647 | |
| A.C. full wave | | | 3.183 | 5.00 |

TABLE 6

| CRYSTALLINE ELECTROLYTIC COLORATION | Vrms | α/β SCR | Vaverage | Vpeak |
|---|---|---|---|---|
| TRANSFORMER (Maximum voltage) | 20.00 | | 18.00 | 28.27 |
| POSITIVE SEMI-CYCLE: | | | | |
| SCR conduction angle, (minimum) | | 10.19° | | 5.00 |
| SCR conduction angle | | 90.00° | 0.796 | 5.00 |
| NEGATIVE SEMI-CYCLE: | | | | |
| SCR conduction angle | | 10.00° | 0.002 | 0.87 |
| A.C.-complex | | | 0.798 | |
| A.C. full wave | | | 3.183 | 5.00 |

Example 3: Grey Crystalline Electrolytic Coloration.

Anodizing phase: The part to be treated is previously anodized under conditions similar to example 1.

Phase to modify the barrier film: The anodized part is then treated to modify the crystalline structure of the barrier film, under conditions similar to example 2.

Coloration phase as such: The part then undergoes an electrolytic deposition treatment of metallic particles, under conditions similar to example 1.

When this phase is over a bluish grey-opaque colour is obtained, which is very similar to that obtained using the system of integral coloration with silicon alloy.

Example 4: Orange Crystalline Electrolytic Coloration.

Anodizing phase: The part to be treated is previously anodized under conditions similar to example 1.

Phase to modify the barrier film: The anodized part is then treated to modify the crystalline structure of the barrier film, under the following conditions:

| | |
|---|---|
| a) Composition of the electrolyte: | |
| $SnSO_4$ | 4 g/l |
| o-phenolsulphonic acid | 1 g/l |
| $H_2SO_4$ | 10 g/l |
| b) Temperature | 22° C. |
| c) Duration | 18 minutes |
| d) Current type | AC-Complex |

Figure 11:
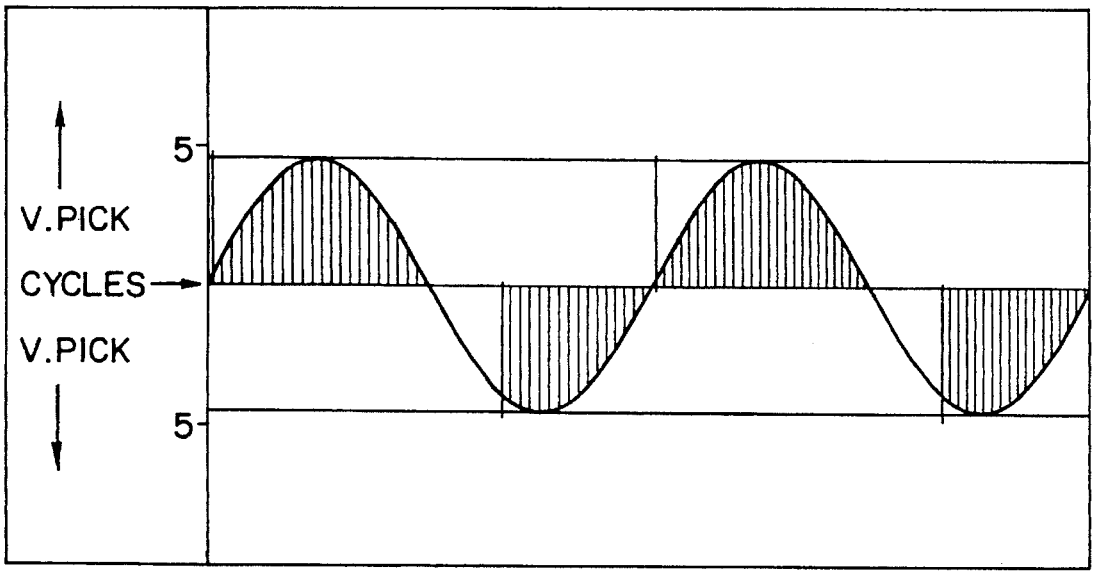
FIGS. 11 and 12.-Finally show the wave shapes of an orange crystalline electrolytic coloration.
Figure 12:
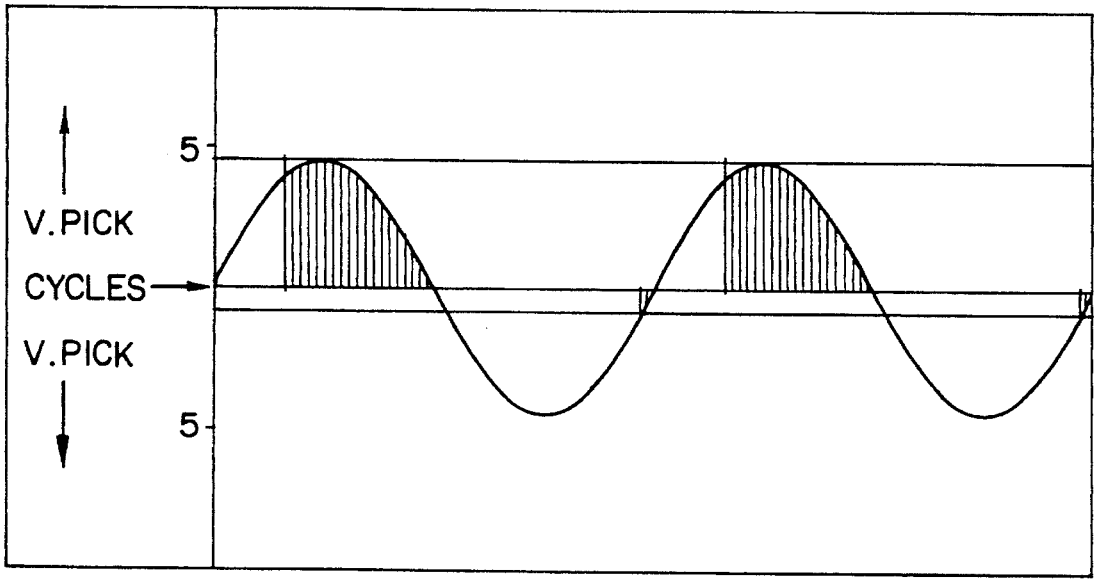

The characteristics and wave shape are detailed in tables 7 and 8 and in FIGS. 11 and 12. During the process the conduction angles of the positive and negative semi-cycles are separately modified in order to control current circulation (at a value below 170 mA/dm$^2$) between the initial and final process conditions.

Coloration phase as such: The part then undergoes an electrolytic deposition treatment of metallic particles, under the following conditions:

| | |
|---|---|
| a) Composition of the electrolyte: The same as in the above phase to modify the barrier film. | |
| b) Temperature of the electrolyte: The same as in the above phase to modify the barrier film. | |
| c) Duration | 1 minute |
| d) Current type | A.C.-Complex |

The characteristics and wave shape are detailed in tables 3 and 4 and in FIGS. 7 and 8. During the process the conduction angles of the positive and negative semi-cycles are separately modified in order to control current circulation (at a value below 0.40 A/dm$^2$) between the initial and final process conditions.

When this phase is over a beautiful orange colour is obtained, very similar in appearance to that obtained in coloration by immersion with organic colouring.

TABLE 7

| CRYSTALLINE ELECTROLYTIC COLORATION | Vrms | α/β SCR | Vaverage | Vpeak |
|---|---|---|---|---|
| TRANSFORMER (Maximum voltage) | 20.00 | | 18.00 | 28.27 |
| POSITIVE SEMI-CYCLE: | | | | |
| SCR conduction angle, (minimum) | | 9.16° | | 4.50 |
| SCR conduction angle | | 175.00° | 1.430 | 4.50 |
| NEGATIVE SEMI-CYCLE: | | | | |
| SCR conduction angle | | 120.00° | 1.074 | 4.50 |

TABLE 7-continued

| CRYSTALLINE ELECTROLYTIC COLORATION | Vrms | α/β SCR | Vaverage | Vpeak |
|---|---|---|---|---|
| A.C.-complex | | | 2.504 | |
| A.C. full wave | | | 2.865 | 4.50 |

TABLE 8

| CRYSTALLINE ELECTROLYTIC COLORATION | Vrms | α/β SCR | Vaverage | Vpeak |
|---|---|---|---|---|
| TRANSFORMER (Maximum voltage) | 20.00 | | 18.00 | 28.27 |
| POSITIVE SEMI-CYCLE: | | | | |
| SCR conduction angle, (minimum) | | 9.16° | | 4.50 |
| SCR conduction angle | | 120.00° | 1.074 | 4.50 |
| NEGATIVE SEMI-CYCLE: | | | | |
| SCR conduction angle | | 10.00° | 0.002 | 0.78 |
| A.C.-complex | | | 1.076 | |
| A.C. full wave | | | 2.865 | 4.50 |

We claim:

1. A process for obtaining a range of colors of the visible spectrum using electrolysis on anodized aluminum, comprising a first phase to form an anodic film which comprises a barrier film, a second phase to modify the barrier film and a third phase to deposit metallic particles on the barrier film, wherein:

a thickness in excess of 0.3 μm is obtained during the first phase of formation of the anodic film;

the second phase includes electrolytic modification of a crystalline lattice of the barrier film which is carried out in an electrolyte, applying a voltage and a current density; and the third phase is carried out by an electrolytic deposition of metallic particles in order to increase internal reflections under a deposit of metallic particles, and wherein:

the electrolyte used in said electrolytic modification of the crystalline lattice of the barrier film has a dissolving power in aluminum oxide equivalent to a solution of sulphuric acid at a concentration of less than 12 g/l and at room temperature in a range between 20° and 25° C.;

obtaining of the various colors is effected by said electrolytically modifying the crystalline lattice of the barrier film and then electrolytically depositing metallic particles, and wherein said electrolytic modification of the crystalline lattice of the barrier film depends on:

peak voltages of positive and negative semi-cycles of an AC-Complex current applied, average voltages of the positive and negative semi-cycles of the AC-Complex current applied, and wherein the average voltages of the positive and negative semi-cycles of the AC-Complex current applied are less than 7 volts.

2. A process for obtaining a range of colors of the visible spectrum using electrolysis on anodized aluminum, as in claim 1, wherein:

the voltage applied in said electrolytic modification is below 5 volts of a complex alternating current.

3. A process for obtaining a range of colors of the visible spectrum using electrolysis on anodized aluminum, as in claim 1, wherein:

the current density applied in said electrolytic modification is less than 200 mA/dm$^2$ of a complex alternating current.

4. A process for obtaining a range of colors of the visible spectrum using electrolysis on anodized aluminum, comprising a first phase to form an anodic film which comprises a barrier film, a second phase to modify the barrier film and a third phase to deposit metallic particles on the barrier film, wherein:

a thickness in excess of 0.3 μm is obtained during the first phase of formation of the anodic film;

the second phase includes electrolytic modification of a crystalline lattice of the barrier film which is carried out in an electrolyte, applying a voltage and a current density; and the third phase is carried out by an electrolytic deposition of metallic particles in order to increase internal reflections under a deposit of metallic particles, and wherein the electrolyte used in said electrolytic modification of the crystalline lattice of the barrier film has a dissolving power in aluminum oxide equivalent to a solution of sulphuric acid at a concentration of less than 12 q/l and at room temperature in a range between 20° and 25° C.; and wherein said voltage in said second phase includes peak voltages of positive and negative semi-cycles of an AC-Complex current applied of less than 7 volts.

5. A process for obtaining a range of colors of the visible spectrum using electrolysis on anodized aluminum, as in claim 1, wherein:

the average voltages of the positive and negative semi-cycles of the AC-Complex current applied are less than 2.5 volts.

6. A process for obtaining a range of colors of the visible spectrum using electrolysis on anodized aluminum, as in claim 1, wherein:

an average intensity of the AC-Complex current applied is less than 200 mA/dm$^2$.

7. A process for obtaining a range of colors of the visible spectrum using electrolysis on anodized aluminum, as in claim 1, wherein a distance between an upper part of the deposit of the metallic particles and an aluminum-alumina interface is less that 50 nm.

8. A process for obtaining a range of colors of the visible spectrum using electrolysis on anodized aluminum, wherein in order to obtain a white-opaque color, the process comprises two phases wherein:

at the first phase an anodic film which comprises a barrier film is formed having a thickness in excess of 0.3 μm; and at the second phase a crystalline lattice of the barrier film is electrolytically modified in an electrolyte, applying a voltage and a current density and wherein:

the electrolyte used in said electrolytic modification has a dissolving power in aluminum oxide equivalent to a solution of sulphuric acid at a concentration of less than 12 g/l and at room temperature in a range between 20° and 25° C.; and wherein in order to obtain a white-opaque color, the process comprises said two phases and the voltage applied in said electrolytic modification is below 5 volts of a complex alternating current.

9. A process for obtaining a range of colors of the visible spectrum using electrolysis on anodized aluminum, as in claim 8, wherein in order to obtain a white-opaque color, an average current density applied in said electrolytically modification is less than 120 $mA/dm^2$ of a complex alternating current.

10. A process for obtaining a range of colors of the visible spectrum using electrolysis on anodized aluminum as in claim 8, wherein in order to obtain a grey color, a white-opaque color is previously obtained in accordance with said first and second phases, followed by a third phase of electrolytic deposition of metallic particles.

* * * * *